US007229398B2

(12) United States Patent
Sakuma et al.

(10) Patent No.: US 7,229,398 B2
(45) Date of Patent: Jun. 12, 2007

(54) CIRCULAR-SHAPED METAL STRUCTURE AND METHOD OF FABRICATING THE SAME

(75) Inventors: Masaru Sakuma, Yokohama (JP); Youji Ito, Tsubame (JP)

(73) Assignees: Dymco Limited (JP); K.K. Endo Seisakusho (JP)

( * ) Notice: Subject to any disclaimer, the term of this patent is extended or adjusted under 35 U.S.C. 154(b) by 471 days.

(21) Appl. No.: 10/696,353

(22) Filed: Oct. 29, 2003

(65) Prior Publication Data

US 2004/0098855 A1 May 27, 2004

(30) Foreign Application Priority Data

Nov. 27, 2002 (JP) ..... 2002-343714

(51) Int. Cl.
*B25F 5/02* (2006.01)

(52) U.S. Cl. ..... 492/58; 492/56; 492/54

(58) Field of Classification Search ..... 492/54, 492/53, 49; 29/25.42

See application file for complete search history.

(56) References Cited

U.S. PATENT DOCUMENTS

| | | | | |
|---|---|---|---|---|
| 1,974,441 | A * | 9/1934 | Andersen | 205/137 |
| 3,826,124 | A | 7/1974 | Baksay | 72/370.25 |
| 4,173,876 | A | 11/1979 | Schaefer | 72/85 |
| 4,200,051 | A | 4/1980 | Nakahara et al. | 113/120 |
| 4,357,618 | A * | 11/1982 | Ragland | 347/125 |
| 4,987,046 | A | 1/1991 | Kutami et al. | 430/127 |
| 5,035,197 | A | 7/1991 | Enoguchi et al. | 118/647 |
| 5,121,139 | A | 6/1992 | Burke | 346/138 |
| 5,128,091 | A | 7/1992 | Agur et al. | 264/512 |
| 5,321,889 | A | 6/1994 | Watanabe | 29/895.3 |
| 5,324,248 | A | 6/1994 | Quigley | 492/50 |
| 5,669,578 | A | 9/1997 | Ma | 242/613.5 |
| 6,014,999 | A | 1/2000 | Browne | 156/512 |
| 6,106,762 | A | 8/2000 | Agur et al. | 264/512 |
| 6,110,629 | A | 8/2000 | Ehara et al. | 430/84 |
| 6,426,861 | B1 * | 7/2002 | Munshi | 361/312 |
| 6,716,148 | B1 | 4/2004 | Fortin et al. | 492/47 |
| 6,722,002 | B1 * | 4/2004 | Chang et al. | 29/17.2 |
| 2002/0025486 | A1 | 2/2002 | Nukada et al. | 430/112 |
| 2002/0146259 | A1 * | 10/2002 | Zhou et al. | 399/329 |

FOREIGN PATENT DOCUMENTS

| | | | |
|---|---|---|---|
| DE | 300696 | 7/1992 | 72/85 |
| EP | 1 106 278 | 12/2000 | |
| JP | 53-46472 | 4/1978 | |
| JP | 57-056118 | 4/1982 | |
| JP | 57-085618 | 5/1982 | |
| JP | 58-35025 | 3/1983 | 72/85 |
| JP | 58-84619 | 5/1983 | 72/84 |
| JP | 58-107223 | 6/1983 | |
| JP | 58-107224 | 6/1983 | |
| JP | 61-107008 | 5/1986 | |

(Continued)

*Primary Examiner*—Marc Jimenez
(74) *Attorney, Agent, or Firm*—Hayes Soloway P.C.

(57) ABSTRACT

A circular-shaped metal structure is fabricated by plastic-working and has a wall thickness in the range of 0.03 mm to 0.09 mm both inclusive. A film composed of one of (a) silicon and fluorocarbon resin and (b) copper is coated on a surface of the circular-shaped metal structure.

11 Claims, 5 Drawing Sheets

FOREIGN PATENT DOCUMENTS

| | | | |
|---|---|---|---|
| JP | 64-034527 | | 2/1989 |
| JP | 01-130822 | | 5/1989 |
| JP | 4-300071 | * | 10/1992 |
| JP | 07-284452 | | 10/1995 |
| JP | 09-085355 | | 3/1997 |
| JP | 09-140583 | | 6/1997 |
| JP | 10-010893 | | 1/1998 |
| JP | 10140387 A | * | 5/1998 |
| JP | 2001-225134 | | 8/2001 |
| JP | 2001-330081 | | 11/2001 |
| JP | 2002-169392 | | 6/2002 |
| SD | 1750796 | | 7/1992 ..... 72/85 |

* cited by examiner

CIRCULAR-SHAPED METAL STRUCTURE AND METHOD OF FABRICATING THE SAME

BACKGROUND OF THE INVENTION

1. Field of the Invention

The invention relates to a thin-walled circular-shaped metal structure and a method of fabricating the same, and more particularly to such a metal structure usable as a photosensitive drum or a fixing roller in an electrophotographic printer or copier, and a method of fabricating the same.

2. Description of the Related Art

For instance, in accordance with Japanese Unexamined Patent Publication No. 10-10893, a film of which a photosensitive drum or a fixing drum used in a conventional electrophotographic printer and copier is formed is composed generally of organic material such as polyimide or metal as inorganic material, such as iron, aluminum, stainless steel and nickel.

Such a film generally has a practical thickness in the range of 0.03 to 0.20 mm. However, such a practical thickness can be accomplished only by a film composed of polyimide or nickel. For instance, a nickel film having such a thickness can be fabricated by electrocasting.

It is generally said that a fixation section consumes about 80% of power to be totally consumed in an electrophotographic printer or copier. In addition, power consumption depends highly on material of which a fixing roller or a fixing film is composed.

For instance, if a fixing roller or film is composed of polyimide, which is organic material having a thermal conductivity 1/510 to 1/40 smaller than a thermal conductivity of the above-mentioned iron, aluminum, stainless steel or nickel, it would be necessary to heat a fixing roller or film much time until the fixing roller or film become workable. A period of time in which a fixing roller or film is heated is a time in which a user has to wait after a printer or copier has been turned on until the printer or copier becomes workable.

It is desired in business that a printer or copier becomes workable as soon as possible, and hence, a fixing roller or film has to be preheated even when the printer or copier is not in use, resulting in increase in power consumption.

On the other hand, if a fixing roller or film is composed of nickel having a thermal conductivity 210 times greater than a thermal conductivity of polyimide, it would be possible to shorten a time for heating the fixing roller or film until the fixing roller or film becomes workable. As a result, it is no longer necessary to preheat a fixing roller or film, and hence, a printer or copier including the fixing roller or film composed of nickel becomes workable immediately when the printer or copier is turned on.

As mentioned above, power consumption in a printer or copier can be reduced by using a nickel film as a fixing film. However, a conventional method of fabricating a nickel film is accompanied with problems as follows.

As mentioned earlier, a nickel film having a thickness of 0.03 to 0.20 mm is fabricated by electrocasting. That is, such a nickel film is fabricated by precipitating nickel ions by electrolysis. Hence, the thus fabricated nickel film has such columnar crystal structure, and resultingly, has a shortcoming that the nickel film is weak to mechanically repeated stress.

In addition, in accordance with a fatigue test, a nickel film has a lifetime in the range of a couple of tens thousand rotation to a couple of millions rotation. There is much dispersion in lifetime of a nickel film.

In particular, a nickel film fabricated by electrocasting shows remarkable thermal embrittlement when heated to a temperature over 200 degrees centigrade. Hence, a nickel film fabricated by electrocasting is not suitable as a fixing film.

Though ions can be readily precipitated out of pure metal by electrocasting, it is almost impossible to precipitate ions out of an alloy such as stainless steel.

As another method of fabricating a metal cylindrical film, there has been suggested a method including the steps of rounding a thin film having a thickness in the range of 0.03 to 0.20 mm, and welding the thus rounded film into a cylinder-shaped film. According to this method, any metal may be used for fabricating a metal cylindrical film.

However, this method is accompanied with problems of shortage in a mechanical strength and non-uniformity in a shape of a cylinder, due to a bead treatment at a welded portion, and further due to defect in a welded portion with respect to a metal structure. In addition, since a metal cylindrical film is fabricated in the method by splicing thin films to each other, skill and much time are required for fabricating a metal cylindrical film, resulting in increase in cost and absence of mass-productivity. Hence, the method is not put to practical use yet.

SUMMARY OF THE INVENTION

In view of the above-mentioned problems in the conventional method of fabricating a metal cylinder film, it is an object of the present invention to provide a circular-shaped metal structure such as a metal cylinder film which has sufficient mechanical strength and lifetime, and is suitable for mass-production.

It is also an object of the present invention to provide a method of fabricating such a circular-shaped metal structure.

The applicant suggested the circular-shaped metal structure in Japanese Patent Application Publication No. 2001-225134 corresponding to U.S. Pat. No. 6,561,001 issued on May 13, 2003. The applicant suggests the present invention to apply further improvements to the circular-shaped metal structure.

In one aspect of the present invention, there is provided a circular-shaped metal structure fabricated by plastic-working and having a wall thickness in the range of 0.03 mm to 0.09 mm both inclusive, a film composed of one of (a) silicon and fluorocarbon resin and (b) copper being coated on a surface of the circular-shaped metal structure.

In the specification, the term "circular-shaped metal structure" covers a structure composed of metal, and having a closed and loop-shaped cross-section in a direction perpendicular to an axis thereof. For instance, a typical circular-shaped metal structure is a metal cylinder. A belt, a sleeve, a pipe and the like are all included in the term "circular-shaped metal structure".

There is further provided a circular-shaped metal structure fabricated by plastic-working and having a wall thickness in the range of 0.03 mm to 0.09 mm both inclusive, the circular-shaped metal structure being comprised of a plurality of metals different from one another and integrally rolled.

For instance, stainless steel and copper may be selected as the metals.

As stainless steel, SUS304 corresponding to AISI304 in U.S. may be selected.

It is preferable that a ratio A:B is in the range of 1:2 to 29:1 both inclusive wherein A indicates a thickness of the stainless steel and B indicates a thickness of the copper.

It is preferable that the circular-shaped metal structure has a wall thickness of 0.03 mm, in which the stainless steel has a thickness in the range of 0.01 mm to 0.029 mm both inclusive and the copper has a thickness in the range of 0.02 mm to 0.001 mm both inclusive.

It is preferable that a film composed of silicon and fluorocarbon resin is coated on a surface of the circular-shaped metal structure, in which case, it is preferable that the film is coated only on an outer surface of the circular-shaped metal structure.

It is preferable that the circular-shaped metal structure is plated at a surface thereof with copper, in which case, it is preferable that the circular-shaped metal structure is plated only at an outer surface thereof with copper.

It is preferable that a reduction rate of a thickness of the circular-shaped metal structure after plastic-worked to a thickness of the circular-shaped metal structure before plastic-worked is equal to or greater than 40%.

It is preferable that the circular-shaped metal structure has a Vickers hardness Hv equal to or greater than 380 after plastic-worked.

It is preferable that the circular-shaped metal structure has a Vickers hardness Hv in the range of 100 to 250 both inclusive after plastic-worked and then annealed.

For instance, spinning-working may be selected as the plastic-working. However, the circular-shaped metal structure may be fabricated by plastic-working other than spinning-working.

In another aspect of the present invention, there is provided a method of fabricating a circular-shaped metal structure, including rotating a pipe around an axis thereof, the pipe being composed of plastic-workable metal, applying drawing to an outer wall of the pipe with the pipe being kept rotated, to reduce a wall thickness of the pipe and lengthen a wall length of the pipe, and coating a film composed of one of (a) silicon and fluorocarbon resin and (b) copper on a surface of the pipe.

There is further provided a method of fabricating a circular-shaped metal structure, including rolling a plurality of metals different from one another into a piece of metal, fabricating a pipe from the metal, rotating the pipe around an axis thereof, and applying drawing to an outer wall of the pipe with the pipe being kept rotated, to reduce a wall thickness of the pipe and lengthen a wall length of the pipe.

In accordance with the above-mentioned method, it is possible to fabricate a circular-shaped metal structure usable as a photosensitive drum or a fixing roll by applying spinning-working to a pipe.

By coating a film composed of silicon and fluorocarbon resin, or copper onto a surface of the pipe, when a sheet such as a protection paper is adhered to a surface of the circular-shaped metal structure, the sheet can be readily peeled off.

In the specification, the term "pipe" includes a pipe having a bottom and a pipe having no bottom. A pipe having a bottom can be fabricated by warm or cold drawing, and a pipe having no bottom can be fabricated by rounding a thin film and welding the thin film at opposite ends. The pipe is annealed to control a hardness thereof, if necessary, and then, is spinning-worked to have a thickness in the range of 0.03 to 0.09 mm both inclusive.

Then, if necessary, the pipe is annealed again at a low temperature. The resultant circular-shaped metal structure is stiff, has a high resistance to fatigue and a high thermal conductivity, and is superior as a photosensitive drum or a fixing drum.

Table 1 shows comparison in performances between a thin-walled circular-shaped metal structure fabricated in accordance with the above-mentioned method and a thin-walled circular-shaped metal structure fabricated in accordance with drawing as a conventional method. It is assumed in Table 1 that a circular-shaped metal structure is used as a fixing roller.

TABLE 1

| Thickness | Invention | | | | Drawing | | | |
|---|---|---|---|---|---|---|---|---|
| [mm] | A | B | C | D | A | B | C | D |
| 0.10 | ○ | ○ | ○ | ○ | ○ | ○ | ○ | ○ |
| 0.09 | ○ | ○ | ○ | ○ | X | X | X | X |
| 0.08 | ○ | ○ | ○ | ○ | X | X | X | X |
| 0.07 | ○ | ○ | ○ | ○ | X | X | X | X |
| 0.06 | ○ | ○ | ○ | ○ | X | X | X | X |
| 0.05 | ○ | ○ | ○ | ○ | X | X | X | X |
| 0.04 | ○ | ○ | ○ | ○ | X | X | X | X |
| 0.03 | ○ | ○ | ○ | ○ | X | X | X | X |
| 0.02 | X | X | X | X | X | X | X | X |

In Table 1, the column "A" indicates uniformity in a thickness, the column "B" indicates straightness or a degree of curvature, the column "C" indicates hardness, and the column "D" indicates total estimate. A circle (○) in the columns A, B and C indicates that the circular-shaped metal structure passes the test, and a cross (X) in the columns A, B and C indicates the circular-shaped metal structure cannot pass the test.

For instance, a circular-shaped metal structure having a thickness of 0.09 mm, fabricated in accordance with the present invention, passes the tests with respect to uniformity in a thickness, straightness, and a hardness, whereas a circular-shaped metal structure having a thickness of 0.09 mm, fabricated in accordance with the conventional method, cannot pass the tests with respect to the same.

In Table 1, both a circular-shaped metal structure fabricated in accordance with the present invention and a circular-shaped metal structure fabricated in accordance with a conventional method, that is, drawing are tested with respect to uniformity in a thickness, straightness, and a hardness. Total estimate in the column D was made taking the results of the tests in the columns A, B and C into consideration. A circle (○) in the column D indicates that the circular-shaped metal structure is practically usable, and a cross (X) in the column D indicates the circular-shaped metal structure is practically unusable.

As is obvious in view of Table 1, a thin-walled circular-shaped metal structure fabricated in accordance with the conventional method has to have a thickness of 0.10 mm or greater in order to be practically usable. Even if a circular-shaped metal structure having a thickness of 0.09 mm or smaller is fabricated in accordance with the conventional method, the circular-shaped metal structure cannot be practically usable.

In contrast, as is obvious in view of Table 1, the present invention can provide a circular-shaped metal structure having a thickness in the range of 0.03 mm to 0.10 mm both inclusive, which is practically usable.

Thus, the present invention makes it possible to fabricate a circular-shaped metal structure having a thickness of 0.09 mm or smaller, which could not be fabricated in accordance with the conventional method.

In still another aspect of the present invention, there is provided a photosensitive drum to be used in an electrophotographic printer, the photosensitive drum being comprised of the above-mentioned circular-shaped metal structure.

In yet another aspect of the present invention, there is provided a fixing belt to be used in an electrophotographic printer, the fixing belt being comprised of the above-mentioned circular-shaped metal structure.

In still yet another aspect of the present invention, there is provided a roller assembly including (a) at least two rollers arranged such that axes of the rollers are directed in parallel to one another, and (b) a belt wound around the rollers, wherein the belt is comprised of the above-mentioned circular-shaped metal structure.

The advantages obtained by the aforementioned present invention will be described hereinbelow.

Printing technology in a printer or copier has remarkably developed. For instance, any document can be copied in full color. Hence, a black-and-white printer or copier will be required to have higher definition in the future, and a color printer or copier will be required to have high quality and a high printing speed, and to be fabricated in smaller cost. A photosensitive drum and a thermal fixer are important keys to meet with such requirements.

In a thermal fixing roller or film, it is required to have a nip area as wide as possible in order to enhance a thermal coefficient and provide qualified image, regardless of whether a thermal fixing roller or film is of a belt type or a thin-walled sleeve type. In response to such requirements, a thin-walled circular-shaped metal structure fabricated in accordance with the present invention can be used as a belt or sleeve having high elasticity, high mechanical strength, and high resistance to fatigue.

The circular-shaped metal structure fabricated in accordance with the present invention has higher durability, higher resistance to heat, higher rigidity and longer lifetime than those of a belt composed of resin or nickel, fabricated in accordance with the conventional method. The circular-shaped metal structure fabricated in accordance with the present invention may be used as a belt. Hence, it will be possible to downsize a printer or copier by using the circular-shaped metal structure fabricated in accordance with the present invention, as a belt, in place of a conventional roller or sleeve having a relatively great thickness.

In addition, the circular-shaped metal structure has high thermal conductivity and small thermal capacity. Accordingly, when the circular-shaped metal structure is used as a fixing drum, the fixing drum can be rapidly warmed up. Thus, a period of time for fixation can be shortened. In addition, the fixing drum would have high thermal conductivity, resulting in reduction in power consumption, and hence, significant reduction in cost.

For instance, the circular-shaped metal structure fabricated in accordance with the present invention may be used as a belt in a photosensitive drum. Since stainless steel of which the circular-shaped metal structure is made would have enhanced strength by being spun, it would be possible to enhance flatness and rigidity between axes when tension force is applied to the circular-shaped metal structure used as a belt, in comparison with a conventional belt composed of resin.

In addition, when the circular-shaped metal structure is used as a belt, since the circular-shaped metal structure has a high Young's modulus, it would be possible to eliminate non-uniformity in rotation caused by extension and/or extraction of a belt, unlike a conventional belt composed of resin. As a result, accuracy in feeding an object could be enhanced, ensuring qualification in images.

Most of conventional photosensitive drums are comprised of a big cylinder composed of aluminum. It would be possible to downsize a printer or copier by using the circular-shaped metal structure as a belt in place of such a conventional photosensitive drum.

Furthermore, it would be possible in a color printer or copier to shorten a period of time in which a sheet passes a plurality of photosensitive drums associated with different colors such as red, green and blue, ensuring a high speed and reduction in weight, and saving a space.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Preferred embodiments in accordance with the present invention will be explained hereinbelow with reference to drawings.

Hereinbelow is explained a method of fabricating a circular-shaped metal structure, as the embodiment of the present invention. In the embodiment, a metal cylinder is fabricated as a circular-shaped metal structure in accordance with the method.

Figure 1:
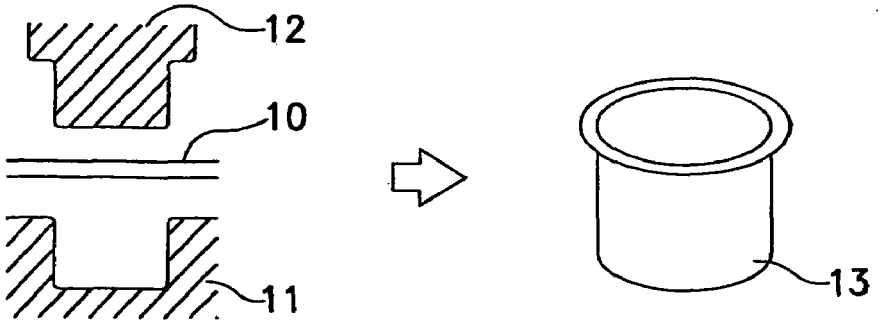
FIG. 1 includes cross-sectional and perspective views showing a step of fabricating a pipe having a bottom, by warm or cold drawing.

First, as illustrated in FIG. 1, a thin metal sheet 10 is placed between a female jig 11 and a punch 12 to fabricate a pipe 13 having a bottom. Deeper the pipe 13 is, more readily the pipe 13 can be spun. Hence, it is preferable that the pipe 13 is fabricated by warm drawing in which the female jig 11 is heated and the punch 12 is cooled.

For instance, it is assumed that SUS304 is placed by warm and cold drawing. If SUS304 is placed at a room temperature, a critical drawing ratio, which is defined as a ratio of a diameter (A) of a cylindrical object to a diameter (B) of a punch (A/B), is 2.0. In contrast, if SUS304 is placed by warm drawing, a critical drawing ratio can be enhanced up to 2.6. Thus, when a pipe having a bottom is to be placed, the pipe could be deeper if placed by warm drawing than if placed by cold drawing.

However, it should be noted that the pipe 13 having a bottom can be fabricated by ordinary cold drawing.

In warm drawing, it is preferable for the metal sheet 10 to have a thickness in the range of 0.1 to 1.0 mm, and more preferable to have a thickness in the range of 0.3 to 0.5 mm.

Then, the pipe 13 is annealed to thereby cause the pipe 13 to have desired hardness.

Figure 2:
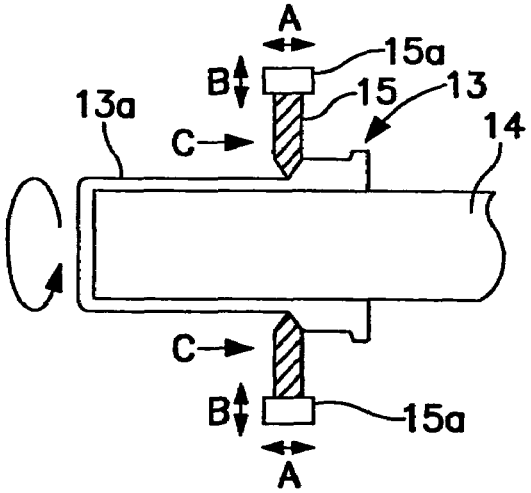
FIG. 2 is a cross-sectional view illustrating an apparatus of spinning a pipe having a bottom.

Then, as illustrated in FIG. 2, the pipe 13 is spinning-worked by means of a spinning machine.

With reference to FIG. 2, the spinning machine is comprised of a pipe rotator 14 which rotates the pipe 13 around an axis thereof, a jig 15 having a tip end having an acute angle, and a mover 15*a* movable both in a direction B perpendicular to the axis of the pipe 13 and in a direction A parallel to the axis of the pipe 13.

The pipe 13 is fixed to the mover 15*a*, and hence, can move both in the directions A and B together with the mover 15*a*.

First, as illustrated in FIG. 2, the pipe rotator 14 is inserted into the pipe 13 having a bottom, and then, the pipe rotator 14 is made to start rotation.

Then, the mover 15*a* moves the jig 15 in the direction B until the jig 15 makes contact with an outer wall 13*a* of the pipe 13. Then, the mover 15*a* further moves the jig 15 in the direction B such that the jig 15 is pressed onto the outer wall 13*a* at uniform pressure. Thus, spinning-working to the outer wall 13*a* of the pipe 13 starts.

As mentioned earlier, the jig 15 is fixed to the mover 15*a*. By moving the jig 15 by means of the mover 15*a*, it is possible to locate the jig 15 remote from an outer surface of the pipe rotator 14. As mentioned later, a distance between the tip end of the jig 15 and an outer surface of the pipe rotator 14 would be equal to a thickness of a later mentioned metal cylinder 18.

Then, the mover 15*a* moves the jig 15 far away from a bottom of the pipe 13, that is, to a direction C with the jig 15 being pressed onto the outer wall 13*a* of the pipe 13. As the jig 15 moves to the direction C, the outer wall 13*a* of the pipe 13 is drawn, and hence, lengthened.

As a result, the pipe 13 would have a thickness equal to a distance between the tip end of the jig 15 and the outer surface of the pipe rotator 14.

Though the jig 15 is used for drawing the outer wall 13*a* of the pipe 13 in the embodiment, a roller made of hard material may be used in place of the jig 15.

After the outer wall 13*a* has been drawn to a smaller thickness in the above-mentioned way, the pipe 13 is taken away from the pipe rotator 14.

The spinning machine may be of a horizontal type or a vertical type. From the standpoint of workability, it is preferable to select a horizontal type spinning machine.

For instance, Japanese Patent Application Publications Nos. 7-284452 and 9-140583 have suggested a method of fabricating a pipe by spinning. However, those Publications do not refer to a thickness of a pipe fabricated in accordance with the method.

If a pipe composed of SUS304 is fabricated by spinning, for instance, it is said that such a pipe could have a thickness equal to or smaller than 0.10 mm, due to a problem of expansion of a spun surface of a pipe.

In contrast, the method in accordance with the embodiment makes it possible for the pipe 13 to have a thickness in the range of 0.03 to 0.09 mm both inclusive, as shown in Table 1.

According to the experiments having been conducted by the inventors, a pipe having a bottom, obtained from a 0.5 mm-thick metal sheet by cold or warm drawing, has Vickers hardness Hv of 330, which means that work-hardening much develops in the pipe. Hence, it was found out that if the pipe was processed to a thickness of 0.15 mm by spinning, at which a thickness reduction rate is 70%, the Vickers hardness Hv of the pipe would become 500 or greater, and as a result, it would be quite difficult to further process the pipe. Accordingly, the inventors had decided to carry out the steps of annealing the pipe 13 fabricated by cold or warm drawing to have desired hardness, and spinning the pipe 13. These steps make it possible to obtain a circular-shaped metal structure having a thickness in the range of 0.03 to 0.09 mm both inclusive.

The pipe 13 fabricated by cold or warm drawing is annealed for controlling hardness thereof preferably at temperature in the range of 400 to 1200 degrees centigrade, more preferably at temperature in the range of 800 to 1100 degrees centigrade.

After annealed, it is preferable that the pipe 13 has a Vickers hardness Hv preferably in the range of 100 to 250 both inclusive, and more preferably in the range of 100 to 150 both inclusive.

Figure 3:
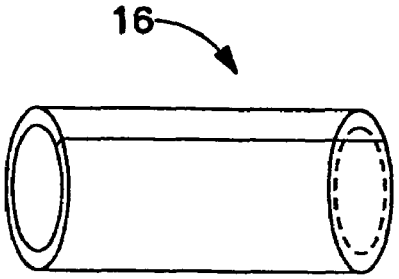
FIG. 3 is a perspective view of a pipe having no bottom, fabricated by rounding a thin film and welding opposite ends to each other.

The pipe 16 having no bottom, illustrated in FIG. 3, fabricated by rounding the metal sheet 10 and welding the opposite ends of the metal sheet 10 to each other, has Vickers hardness Hv of about 150. Hence, the pipe 16 can be processed by spinning to have a thickness of 0.03 to 0.09 mm without being annealed.

A metal sheet from which the pipe 16 is to be fabricated has a thickness preferably in the range of 0.08 to 0.50 mm, and more preferably in the range of 0.10 to 0.15 mm.

The pipe 13 or 16 has a thickness reduction rate in the range of 40 to 91%, and has Vickers hardness Hv in the range of 380 to 500 after being spun. The pipe 13 or 16 has a tensile strength in the range of 150 to 160 kgf/mm$^2$ (1078 to 1568 MPa) after being spun.

This nickel film has Vickers hardness Hv of about 400 to 500, and a tensile strength of about 122 kgf/mm$^2$ (about 1196 MPa). With respect to a ratio of a tensile strength to hardness, the nickel film is smaller than the metal cylinder fabricated by the above-mentioned spinning.

Figure 4:
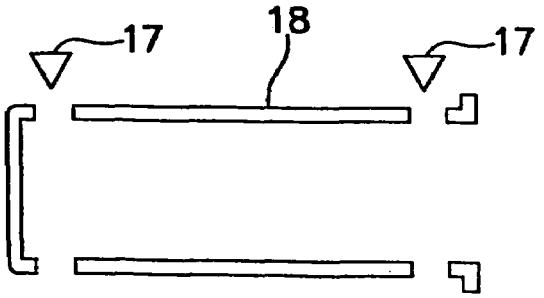
FIG. 4 is a cross-sectional view illustrating that a pipe fabricated by spinning is cut at opposite ends thereof

After the spinning-working to the pipe 13 or 16 has been finished, the pipe 13 or 16 which has a thickness in the range of 0.03 to 0.09 mm is cut in the vicinity of its opposite ends by means of a cutter 17 such that the pipe 13 or 16 has a desired length, as illustrated in FIG. 4.

Thus, there is obtained a metal cylinder 18 usable as a photosensitive or fixing drum.

Then, the metal cylinder 18 is annealed at temperature in the range of 400 to 500 degrees centigrade, preferably at about 450 degrees centigrade, in order to control spring characteristic of SUS304, remove internal stress, and ensure a uniform shape. This annealing would enhance Vickers hardness Hv of the metal cylinder 18 up to 580, and also enhance a tensile strength up to 170 kgf/mm$^2$ (about 1666 MPa).

Figure 5:
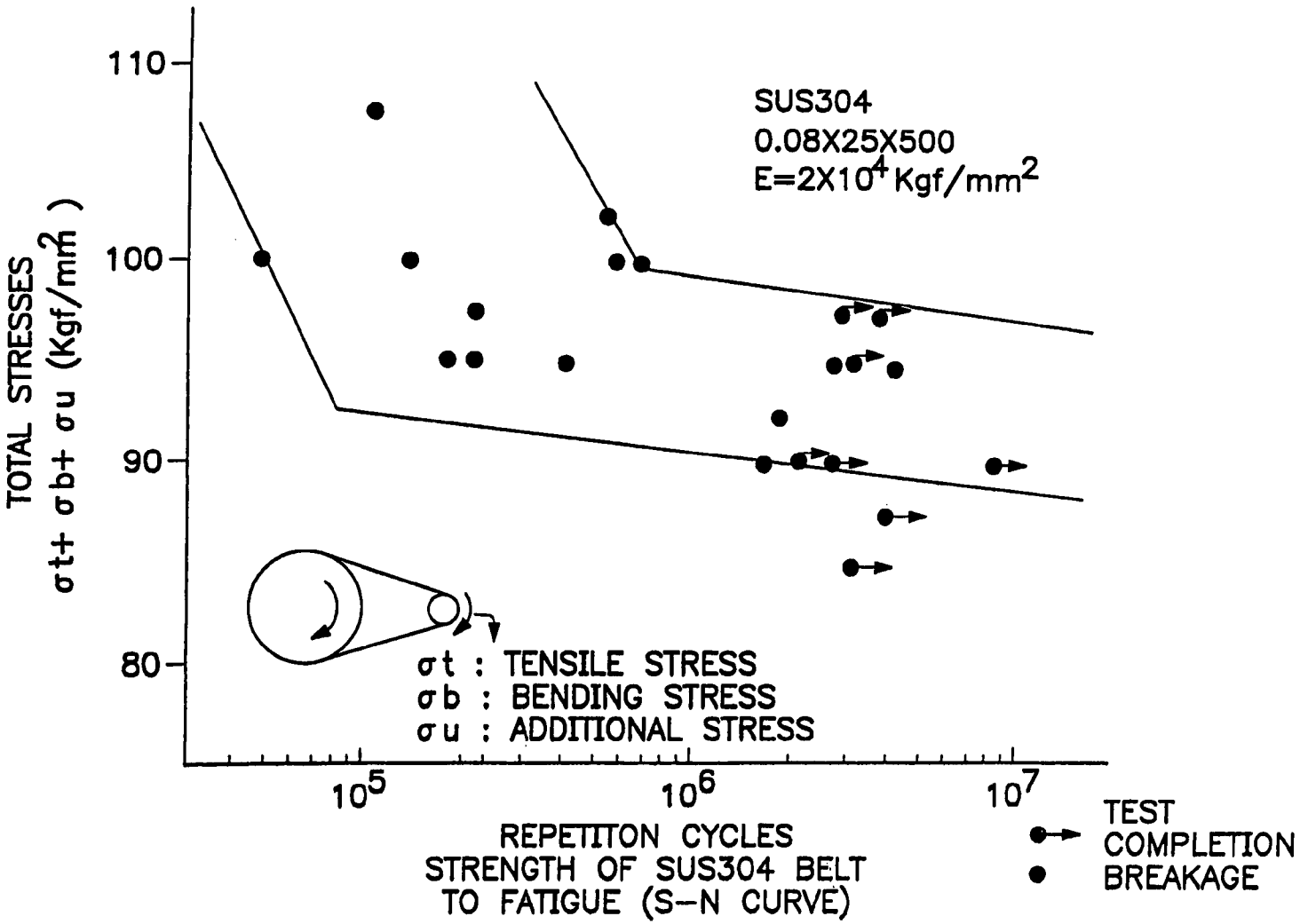
FIG. 5 is a graph showing S-N curves found when a thickness reduction rate is equal to 50% in a cylindrical film composed of SUS304. (As used herein, the term "SUS304" corresponds to "AISI304".)

The inventors conducted a fatigue test to the metal cylinder 18 composed of annealed SUS304, under a condition that a thickness reduction rate is 50%. As illustrated in FIG. 5, strength to fatigue of the metal cylinder 18 was over 80 kgf/mm$^2$ (784 MPa) at a repetition cycle of $10^7$.

In contrast, strength to fatigue of the metal cylinder 18 was 100 kgf/mm$^2$ (980 MPa) under a condition that a thickness reduction rate is 91%.

Thus, it was found out that the metal cylinder composed of SUS304 and fabricated by spinning is superior to the nickel cylindrical film with respect to durability.

Figure 6:
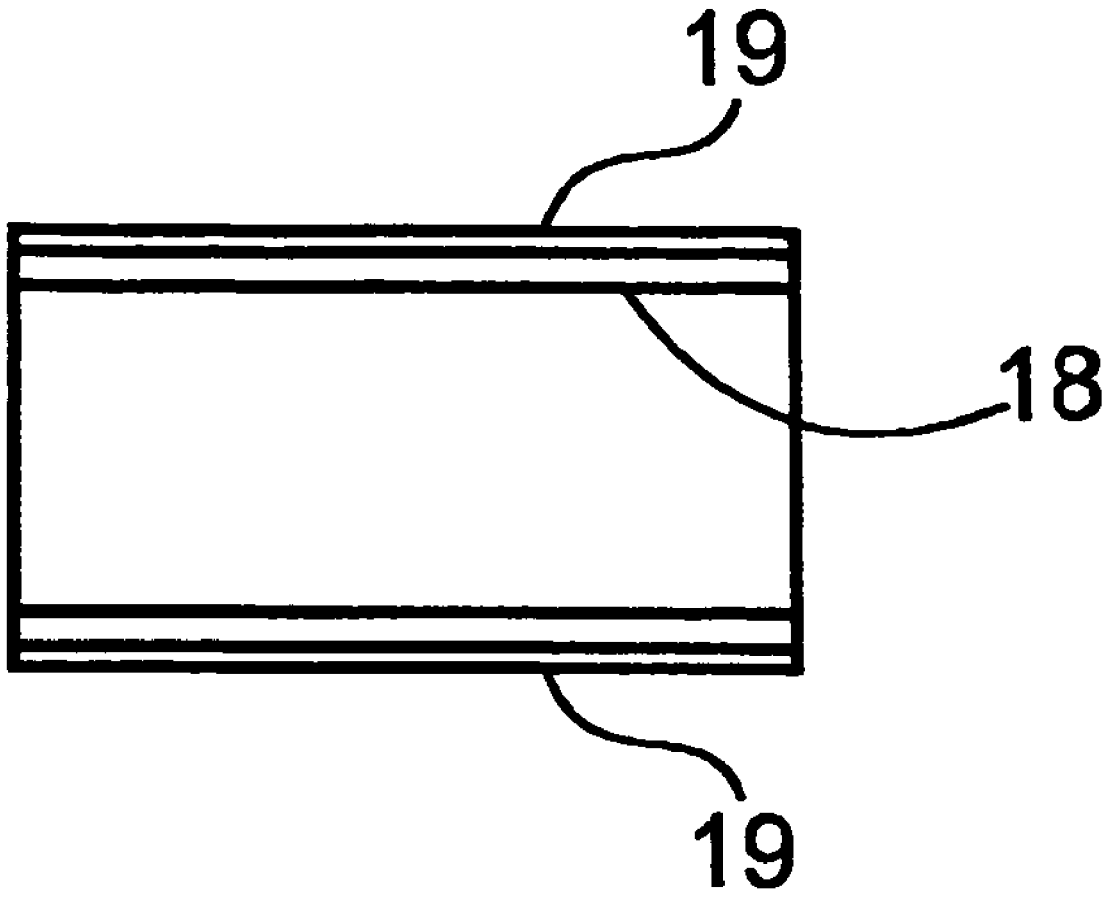
FIG. 6 is a cross-sectional view of a metal cylinder to which a film is coated.

Then, as illustrated in FIG. 6, a coating layer 19 is formed on an outer surface of the metal cylinder 18. The coating layer 19 is comprised of a silicon layer and a fluorocarbon resin layer (so-called "Teflon") formed on the silicon layer.

The coating layer 19 acts as a protection layer for protecting the metal cylinder 18, and prevents the metal cylinder 18 from being oxidized or rusted at an outer surface thereof. Furthermore, when a sheet such as an adhesive paper is wound around the metal cylinder, the sheet could be readily peeled off.

A copper layer may be formed in place of the coating layer 19 on an outer surface of the metal cylinder 18. The copper layer would provide the same advantages as those obtained by the coating layer 19. A copper layer may be formed on an outer surface of the metal cylinder 18 by copper-plating, for instance.

Though the coating layer 19 or the copper layer is formed only on an outer surface of the metal cylinder 18 in the embodiment, it should be noted that the coating layer 19 or the copper layer may be formed on outer and inner surfaces of the metal cylinder 18.

The metal sheet 10 in the embodiment is composed of SUS304.

As an alternative, the metal sheet 10 may be comprised of a plurality of sheets composed of metals different from one another and integrally rolled. For instance, it is preferable that the metal sheet 10 is comprised of a stainless steel sheet and a copper sheet rolled into a single sheet. The stainless steel sheet provides the metal sheet 10 with enhanced durability, and the copper sheet provides the metal sheet 10 with enhanced thermal conductivity.

However, in order to ensure such enhanced durability and enhanced thermal conductivity, it is necessary to determine an appropriate mixture ratio of stainless steel and copper.

The inventors conducted the following experiments in order to determine an appropriate mixture ratio of stainless steel and copper.

First, there were fabricated thirteen metal sheets 10 each comprised of a stainless steel sheet and a copper sheet rolled one on another into a single sheet. A ratio of a thickness of the stainless steel sheet to a thickness of the copper sheet is different from one another among the thirteen metal sheets 10.

Each of the metal sheets 10 was tested with respect to durability and thermal conductivity.

In the durability test, it was observed whether each of the metal sheets 10 was deformed when predetermined pressure or impact force was exerted thereon. In the thermal conductivity test, each of the metal sheets 10 was heated at one of opposite ends thereof up to a predetermined temperature, and then, temperature was measured at the other end after lapse of a predetermined period of time (for instance, five minutes), in order to judge whether each of the metal sheets 10 had desired thermal conductivity.

The results of the experiments are shown in Table 2.

TABLE 2

| Stainless Steel | Copper | Durability | Thermal Conductivity |
|---|---|---|---|
| 1 | 2.5 | Deformed | Good |
| 1 | 2 | Not Deformed | Good |
| 1 | 1.5 | Not Deformed | Good |
| 1 | 1 | Not Deformed | Good |

TABLE 2-continued

| Stainless Steel | Copper | Durability | Thermal Conductivity |
|---|---|---|---|
| 1.5 | 1 | Not Deformed | Good |
| 2 | 1 | Not Deformed | Good |
| 5 | 1 | Not Deformed | Good |
| 10 | 1 | Not Deformed | Good |
| 20 | 1 | Not Deformed | Good |
| 28 | 1 | Not Deformed | Good |
| 29 | 1 | Not Deformed | Good |
| 30 | 1 | Not Deformed | Bad |
| 33 | 1 | Not Deformed | Bad |

As is obvious in light of Table 2, assuming that a ratio X is defined as A:B wherein A indicates a thickness of a stainless steel sheet and B indicates a thickness of a copper sheet, a ratio X which can pass both of the durability and thermal conductivity tests is in the range of 1:2 to 29:1 both inclusive. Accordingly, a thickness ratio of a stainless steel sheet to a copper sheet both of which a metal sheet 10 is comprised should be selected in the range of 1:2 to 29:1 both inclusive.

For instance, if the metal sheet 10 is designed to have a thickness of 0.03 mm (30 microns), a stainless steel sheet is necessarily designed to have a thickness in the range of 0.01 to 0.29 mm, and a copper sheet is necessarily designed to have a thickness in the range of 0.02 to 0.001 mm.

Hereinbelow are explained preferred examples of the above-mentioned method.

EXAMPLE 1

Method of Fabricating a Metal Cylinder Without Welding

In Example 1, a cylindrical film was fabricated from a pipe having a bottom and composed of SUS304, and the cylindrical film was coated at an outer surface thereof with the coating layer 19. The cylindrical film in Example 1 had a thickness of 0.06 mm, an inner diameter of 60.0 mm, and a length of 319 mm. The cylindrical film was used as a fixing roll or a photosensitive drum.

First, a circular sheet having a thickness of 0.5 mm and an inner diameter of 140 mm was cut out from a SUS304 sheet having a thickness of 0.5 mm. Then, the circular sheet was subject to warm-drawing through the use of a punch having an outer diameter of 60.0 mm, to thereby fabricate a pipe having a bottom and having a depth of 70 mm.

A thickness and hardness of the pipe from a neck to a bottom are shown in Table 3.

TABLE 3

| Distance from a neck [mm] | Thickness [mm] | Hardness [Hv] |
|---|---|---|
| 5 | 0.585 | 356 |
| 15 | 0.530 | 342 |
| 25 | 0.490 | 332 |
| 35 | 0.470 | 327 |
| 45 | 0.459 | 308 |
| 55 | 0.456 | 268 |
| 65 | 0.414 | 283 |
| 70 (Bottom) | 0.391 | 287 |

It is understood in view of the thickness profile that the pipe has the greatest thickness in the vicinity of the neck. This means that the material has flown into the neck from the neck. The pipe has a smaller thickness at a location closer to the bottom. This means that the pipe was drawn more intensively at a location closer to the bottom.

With respect to the hardness, it was expected that a portion in the vicinity of the bottom would have the highest hardness, because the portion made contact with a cooled punch. To the contrary, a portion in the vicinity of the bottom had the lowest hardness, and a portion around the neck to which the material was much flown had the highest hardness. This is considered that the material was flown into the neck due to dislocation of the material, and hence, a dislocation density was highest in the vicinity of the neck. As a result, deformation in crystal lattice was greatest in the vicinity of the neck, and such greatest deformation was exhibited as the maximum hardness.

As is obvious in view of Table 3, if the hardness measured at a half of a total height of the pipe, that is, at 35 mm from the neck of the pipe, is considered average hardness, the average hardness is 327.

It is understood in view of Table 3 that non-uniform profile of a thickness and hardness of the pipe fabricated by warm-drawing with respect to a distance from the neck, and hardness in the vicinity of the neck, which is high due to work-hardening are bars to fabrication of a uniform thickness in the range of 0.03 to 0.09 mm by spinning. Hence, it is considered necessary to carry out annealing to have such a uniform thickness.

A pipe having a bottom, fabricated by warm-drawing, was annealed at 1000 degrees centigrade for 30 minutes in vacuum. By annealing the pipe, Vickers hardness at 35 mm from a neck was 134, and Vickers hardness in the rest of the pipe was below 150.

Then, the thus annealed pipe was spinning-worked to have a thickness of 0.06 mm by means of a horizontal type spinning machine. In the spinning, a sufficient amount of cooling water was sprayed to a jig and the pipe in order to remove frictional heat produced by contact of the jig with the pipe, and to prevent increase in a temperature of the pipe.

The resultant pipe had a uniform thickness of 0.06 mm, Vickers hardness of 500, and tensile strength of 166.7 kgf/mm$^2$ (about 1634 Mpa).

Since the pipe still had a bottom, the pipe was cut at its opposite ends. Thus, there was obtained a SUS304 cylindrical film having a thickness of 0.06 mm, an inner diameter of 60.0 mm, and a length of 319 mm.

In addition, the cylindrical film was annealed at 450 degrees centigrade for 30 minutes in order to control spring characteristic thereof. By annealing the cylindrical film, the cylindrical film was reformed to a stiff cylindrical film having Vickers hardness of 570 and tensile strength of 170.3 kgf/mm$^2$ (about 1669 Mpa).

EXAMPLE 2

Method of Fabricating a Metal Cylinder with Welding

In Example 2, a cylindrical film was fabricated from a pipe having no bottom and composed of SUS304, and the cylindrical film was coated at an outer surface thereof with the coating layer 19. The cylindrical film in Example 2 had a thickness of 0.06 mm, an inner diameter of 60.0 mm, and a length of 319 mm. The cylindrical film was used as a fixing roll or a photosensitive drum.

A sheet composed of SUS304 and having a thickness of 0.15 mm and a size of 188.4 mm×144.0 mm was rounded, and welded its opposite ends to each other. As a result, there was fabricated a pipe having no bottom and having an inner diameter of 60.0 mm and a length of 144.0 mm.

Since the sheet had Vickers thickness of 165, the pipe was subject to spinning without annealing, until the pipe had a thickness of 0.06 mm, that is, until a thickness reduction rate became 60%. As a result, there was obtained a metal cylinder having a thickness of 0.06 mm, an inner diameter of 60.0 mm, and a length of 360 mm.

The metal cylinder had a uniform thickness of 0.06 mm, Vickers hardness of 450, and tensile strength of 157.6 kgf/mm$^2$ (about 1544 Mpa).

Then, the metal cylinder was cut at its opposite ends. Thus, there was obtained a SUS304 cylindrical film having a thickness of 0.06 mm, an inner diameter of 60.0 mm, and a length of 319 mm.

Similarly to Example 1, the cylindrical film was annealed at 450 degrees centigrade for 30 minutes in order to control spring characteristic thereof. By annealing the cylindrical film, the cylindrical film was reformed to a stiff cylindrical film having Vickers hardness of 520 and tensile strength of 168.3 kgf/mm$^2$ (about 1649 Mpa).

Though the cylindrical film in Examples 1 and 2 are composed of SUS304, the cylindrical film may be composed of materials other than SUS. For instance, the cylindrical film may be composed of stainless steel, rolled nickel, nickel alloy, titanium, titanium alloy, tantalum, molybdenum, hastelloy, permalloy, marageing steel, aluminum, aluminum alloy, copper, copper alloy, pure iron and steel.

Figure 7:
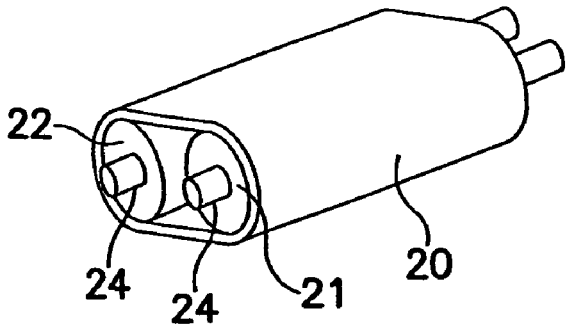
FIG. 7 is a perspective view of a cylindrical metal film used as a part of a roller assembly.
Figure 8:
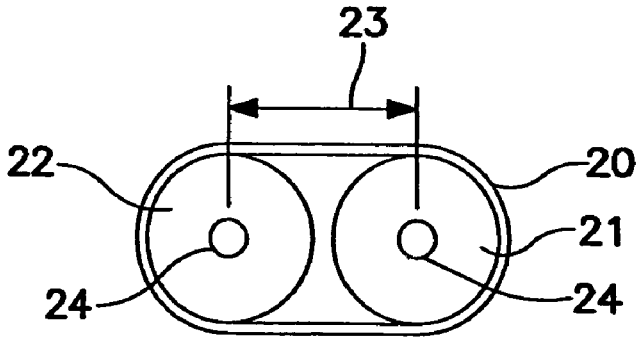
FIG. 8 is a front view of the roller assembly illustrated in FIG. 7.
Figure 9:
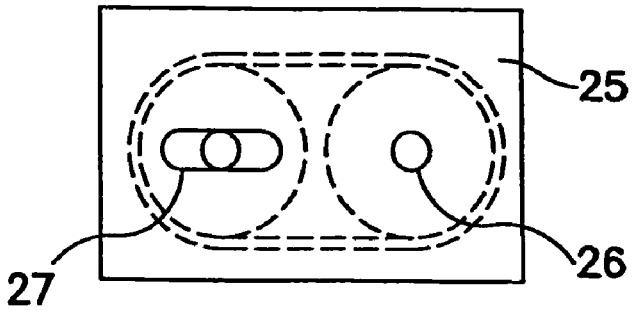
FIG. 9 is a front view of the roller assembly illustrated in FIG. 7.

FIGS. 7 to 9 illustrate an example of a use of the above-mentioned metal cylindrical film. As illustrated in FIGS. 7 to 9, the metal cylindrical film may be used as a part of a roller assembly.

As illustrated in FIGS. 7 and 8, a metal cylindrical film 20 is wound around two rollers 21 and 22 arranged such that axes of the rollers 21 and 22 are parallel to each other. The metal cylindrical film 20 has the same width as a length of the rollers 21 and 22, and hence, entirely covers the rollers 21 and 22 therewith.

The metal cylindrical film 20 is composed of stainless steel and copper integrally rolled, and has a thickness of 0.05 mm (50 micrometers).

As illustrated in FIG. 7, each of the rollers 21 and 22 has support shafts 24 projecting in an axis-wise direction thereof from opposite end surfaces of the rollers 21 and 22. As illustrated in FIG. 9, the rollers 21 and 22 are supported with sidewalls 25 at which the support shafts 24 are rotatably supported.

The sidewall 25 is formed with a circular hole 26 having the same diameter as a diameter of the support shaft 24, and an elongate hole 27 having a height equal to a diameter of the support shaft 24 and a horizontal length longer than a diameter of the support shaft 24.

The roller 21 is supported with the sidewall 25 by inserting the support shaft 24 into the circular hole 26. The roller 22 is fixed to the sidewall 25 by inserting the support shaft 24 into the elongate hole 27, and fixing the support shaft 24 at a desired location in the elongate hole 27 by means of a bolt and a nut, for instance. Thus, since the roller 22 can be fixed at a desired location, the metal cylindrical film 20 can be kept in tension by adjusting a location at which the roller 22 is fixed.

The roller assembly as illustrated in FIGS. 7 to 9 may be used as a photosensitive drum, a heater roll or a fixing roll in a printer.

The rollers 21 and 22 can have a smaller diameter than a diameter of a conventional photosensitive drum. Hence, it would be possible to fabricate a photosensitive drum having a smaller height than a height of a conventional photosensitive drum. Thus, by incorporating the roller assembly including the metal cylindrical film 20, into a printer, it would be possible for a printer to have a significantly smaller height.

Since a conventional heater roll is cylindrical in shape, there exists no planar portion on an outer surface of the heater roll. In contrast, the roller assembly including the metal cylindrical film 20 has a planar portion 23 on the metal cylindrical film 20 in dependence on a distance between the rollers 21 and 22, as illustrated in FIG. 8.

For instance, toner adhering to a paper can be thermally fixed onto the paper on the planar portion 23, which ensures a wider area for thermally fixating toner, than an area presented by a conventional heater roll. As a result, it would be possible to carry out thermal fixation more stably, ensuring enhancement in quality of printed images.

As an alternative, a developing unit may be arranged on the planar portion 23.

In addition, since the metal cylindrical film 20 is thin, the metal cylindrical film 20 has high thermal conductivity. That is, heat is likely to be transferred through the metal cylindrical film 20. This ensures it possible to remarkably shorten a period of time necessary for heating a heater roll in comparison with a conventional heater roll. Accordingly, it is possible to shorten a period of time after a printer has been turned on until the printer becomes workable.

Figure 10:
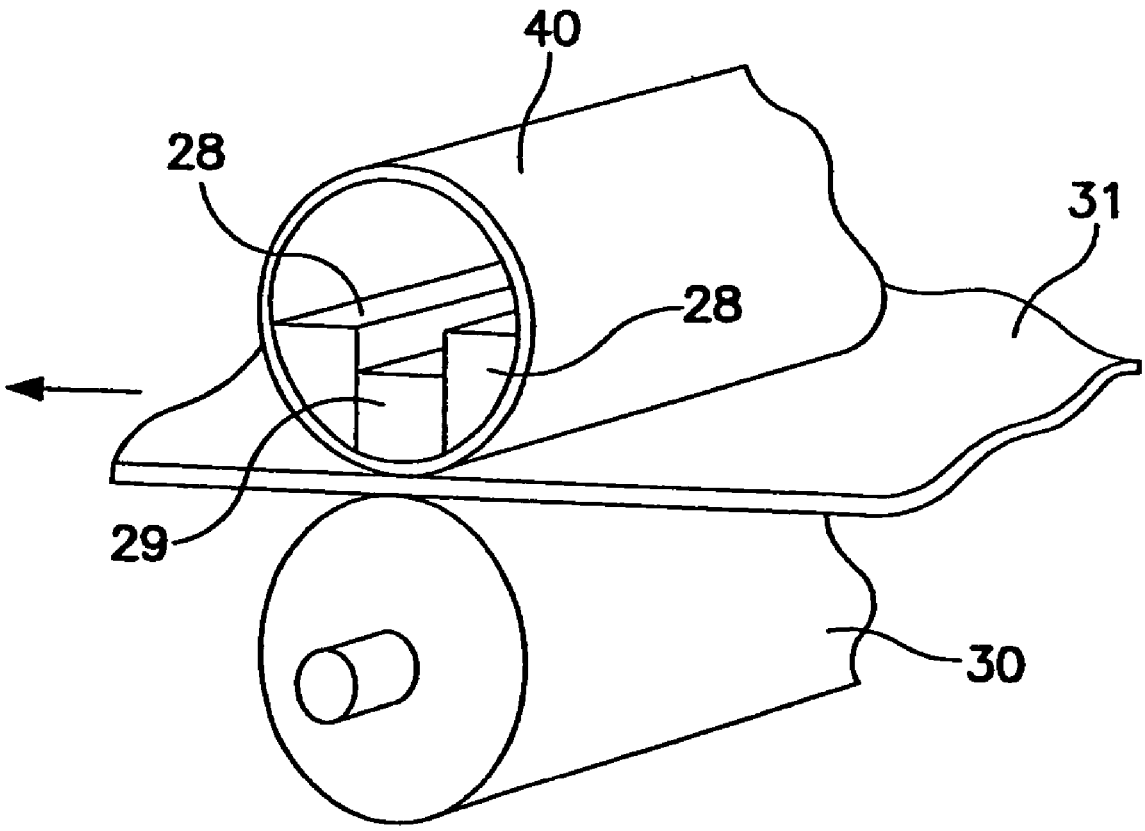
FIG. 10 is a perspective view of a cylindrical metal film used as a fixing roller.

FIG. 10 shows another use of a metal cylindrical film.

A metal cylindrical film 40 may be used as a thermally fixing roll. As illustrated in FIG. 10, a pair of guides 28 is incorporated in the metal cylindrical film 40. The guides 28 have an arcuate outer surface, and hence, can keep the metal cylindrical film 40 to be a cylinder.

A heater 29 is sandwiched between the guides 28. A heater 29 is comprised of a halogen lamp or a ceramic heater, for instance.

A nip roll 30 is located in facing relation to the metal cylindrical film 40 formed as a thermally fixing roll.

A sheet 31 to which toner is adhered is fed towards the metal cylindrical film 40 and the nip roll 30, and then, sandwiched between the metal cylindrical film 40 and the nip roll 30, and subsequently, heated by the heater 29. As a result, toner is thermally fixed to the sheet 31.

By using the metal cylindrical film 40 as a thermally fixing roll, the heater 29 can be arranged in the metal cylindrical film 40, and hence, heat generated by the heater 29 can be transferred directly to the metal cylindrical film 40. Thus, it would be possible to significantly enhance heat transfer efficiency from the heater 29 to the metal cylindrical film 40.

In addition, since the metal cylindrical film 40 is formed of a thin metal sheet, it is possible to rapidly heat the metal cylindrical film 40 up to a temperature necessary for fixing toner onto the sheet 31. Namely, it is possible to shorten a period of time after a printer has been turned on until the printer becomes workable.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2002-343714 filed on Nov. 27, 2002 including specification, claims, drawings and summary is incorporated herein by reference in its entirety.

What is claimed is:

1. A circular-shaped metal structure fabricated by plastic-working and having a wall thickness in the range of 0.03 mm to 0.09 mm both inclusive, said circular-shaped metal structure being formed of a first metal film and a second metal film different from the first integrally rolled together to form an unitary structure, wherein a film composed of silicon and fluorocarbon resin is coated on a surface of said circular-shaped metal structure.

2. The circular-shaped metal structure as set forth in claim 1, wherein said first metal film is comprised of a stainless steel film, and said second metal film is comprised of a copper film.

3. The circular-shaped metal structure as set forth in claim 2, wherein said stainless steel film has a thickness A and said copper film has a thickness B, wherein a ratio A:B is in a range of 1:2 to 29:1 both inclusive.

4. The circular-shaped metal structure as set forth in claim 2, wherein said circular-shaped metal structure has a wall thickness of 0.03 mm, in which said stainless steel film has a thickness in the range of 0.01 mm to 0.029 mm both inclusive and said copper film has a thickness in the range of 0.02 mm to 0.001 mm both inclusive.

5. The circular-shaped metal structure as set forth in claim 1, wherein said film is coated only on an outer surface of said circular-shaped metal structure.

6. The circular-shaped metal structure as set forth in claim 1, wherein said circular-shaped metal structure is plated at a surface thereof with copper.

7. The circular-shaped metal structure as set forth in claim 6, wherein said circular-shaped metal structure is plated only at an outer surface thereof with copper.

8. The circular-shaped metal structure as set forth in claim 1, wherein a reduction rate of a thickness of said circular-shaped metal structure after plastic-working to a thickness of said circular-shaped metal structure before plastic-working is equal to or greater than 40%.

9. The circular-shaped metal structure as set forth in claim 1, wherein said circular-shaped metal structure has a Vickers hardness Hv equal to or greater than 380 after plastic-working.

10. The circular-shaped metal structure as set forth in claim 1, wherein said circular-shaped metal structure has a Vickers hardness Hv in the range of 100 to 250 both inclusive after plastic-working and then annealed.

11. The circular-shaped metal structure as set forth in claim 1, wherein said plastic-working is spinning-working.

* * * * *